United States Patent [19]

Morokuma

[11] Patent Number: 4,909,119

[45] Date of Patent: Mar. 20, 1990

[54] MUSICAL TONE CONTROL SYSTEM WITH A PEDAL FOR ADDING A MUSICAL EFFECT TO A MUSICAL TONE

[75] Inventor: Hiroshi Morokuma, Tokyo, Japan

[73] Assignee: Casio Computer, Tokyo, Japan

[21] Appl. No.: 256,771

[22] Filed: Oct. 11, 1988

[30] Foreign Application Priority Data

Oct. 14, 1987 [JP] Japan ..... 62-259047

[51] Int. Cl.[4] ..... G10H 1/057; G10H 7/00

[52] U.S. Cl. ..... 84/702; 84/DIG. 26; 84/705; 84/707

[58] Field of Search ..... 84/1.24–1.27, 84/DIG. 4, DIG. 26, DIG. 19

[56] References Cited

U.S. PATENT DOCUMENTS 4,067,253 1/1978 Wheelwright et al. ..... 84/1.27 X

FOREIGN PATENT DOCUMENTS 54-23518 2/1979 Japan .
58-97092 6/1983 Japan .
172192 8/1986 Japan .
61-240292 10/1986 Japan .

*Primary Examiner*—Stanley J. Witkowski
*Attorney, Agent, or Firm*—Frishauf, Holtz, Goodman & Woodward

[57] ABSTRACT

An electronic musical instrument for causing a tone generator to generate a musical tone corresponding to a musical performance while controlling an envelope by operation of a pedal. An operated-amount signal generator is provided for detecting an operated amount of the pedal and for generating an operated-amount signal, and an effect adding unit is provided for controlling parameters for effect addition so as to add an effect to a musical tone generated from the musical tone generator in accordance with the operated-amount signal from the operated-amount signal generator. The operated-amount signal from the operated-amount signal generator is changed by the operation of the pedal, and an effect-adding parameter in the effect adding unit is changed accordingly, to thereby add an effect to the generated musical tone.

10 Claims, 12 Drawing Sheets

FIG. 2A
(PRIOR ART)
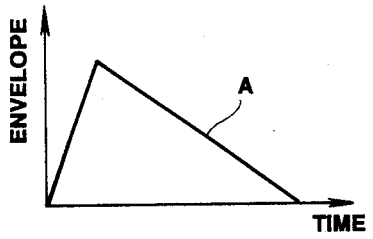
FIG. 2B
(PRIOR ART)
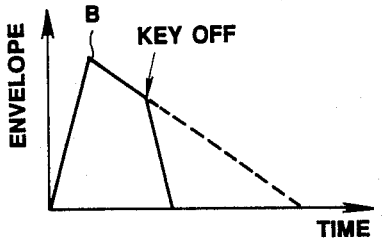
FIG. 3
(PRIOR ART)
| KEY | PEDAL | ENVELOPE |
|---|---|---|
| OFF | OFF | B |
| ON | OFF | A |
| OFF | ON | A |
| ON | ON | A |

FIG. 6 B
| PEDAL VALUE | 0 | 1 | 2 | 3 | 4 |
|---|---|---|---|---|---|
| ENVELOPE | 0 | 1 | 2 | 3 | 4 |
| REVERBERATION AMOUNT | 5 | 10 | 15 | 20 | 50 |
FIG. 6 A
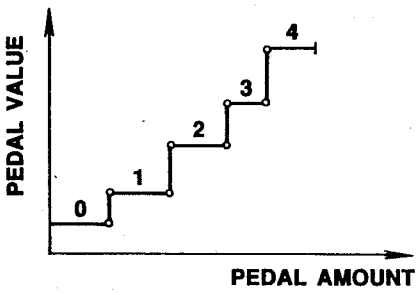
FIG. 6 C
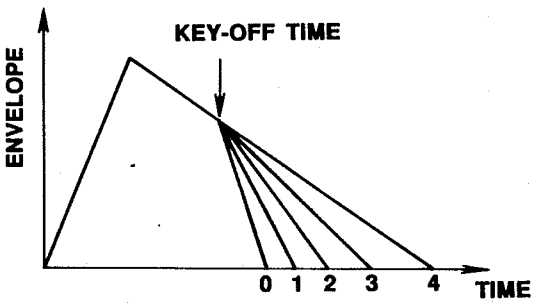

| DAMPER PEDAL | OFF | ON |
|---|---|---|
| ENVELOPE | A | B |
| REVERBERATION AMOUNT | 5 | 20 |

| DAMPER PEDAL | OFF | ON |
|---|---|---|
| ENVELOPE | A | B |
| REVERBERATION AMOUNT | 5 | 20 |
| TREMOLO EFFECT | SMALL | LARGE |
| CHORUS EFFECT | SMALL | LARGE |
| DELAY EFFECT | SMALL | LARGE |

MUSICAL TONE CONTROL SYSTEM WITH A PEDAL FOR ADDING A MUSICAL EFFECT TO A MUSICAL TONE

BACKGROUND OF THE INVENTION

1. Field of the Invention

The present invention relates to an electronic musical instrument, such as an electronic piano, which produces various effects in accordance with the amount of operation of a pedal.

2. Description of the Related Art

Various attempts have been made to make electronic keyboard instruments, such as a piano, using electronic technology.

An electronic piano is a typical type of electronic musical instrument and is provided with a foot-operated switch, such as a damper pedal, sostenuto pedal or soft pedal. The damper pedal reduces a reverberation when turned off and increases it when turned on. The sostenuto pedal, when operated, sustains the key-on status of a key on a keyboard that is operated or depressed to thereby provide a damper effect for each key. The soft pedal reduces the overall volume and provides a soft output sound by varying a filter characteristic.

FIG. 1 is a block diagram illustrating a conventional electronic piano. In the illustrated electronic piano, a CPU (central processing unit) 114 receives data about an operated amount from a keyboard 111, various switches 112, and various pedals 113. CPU 114 controls a memory 115 such as a ROM or a RAM for storing a predetermined program and data and also controls a tone generator 116 and envelope generator 117 in accordance with the operated-amount data. The output of envelope generator 117 is supplied to a sound system 118 from which it is outputted as a musical tone.

A description will be given below of the operation of such an electronic piano with the damper pedal operated. An envelope of an attenuating sound such as a normal piano sound has a long release portion as indicated by "A" in FIG. 2A. When a key off occurs with the damper pedal being in the OFF state, a high release envelope is attained which rapidly falls as indicated by "B" in FIG. 2B. With the damper pedal being ON, even when a key off occurs, a resultant sound follows the envelope A. That is, a sound is generated according to the envelope B only when both a key and the damper pedal are OFF and it is generated according to the envelope A when either one is ON, as shown in FIG. 3.

With regard to an electronic musical instrument with such a pedal, Japanese Patent Disclosure No. 54-23518 discloses technique using a touch release circuit in an electronic musical instrument, which can render a musical tone after key release in a desired sustain state.

Japanese Patent Disclosure No. 58-97092 discloses an electronic musical instrument having the same function as a sostenuto pedal.

Further, Japanese Patent Disclosure No. 61-172192 discloses a conventional technique for controlling the volume, timbre or the like of a musical tone in accordance with the operational status of an operating element, such as a pedal, and the key-touch status.

Let us now consider an acoustic piano. FIG. 4A is a conceptual diagram of a damper section of an acoustic piano, and FIG. 4B is a side view of FIG. 4A. In these figures, each string 121 is provided with a damper 122 which individually operates upon occurrence of a normal key-on/off. Each string 121 has its both ends fixed and its vibration is transmitted through a bridge 123 to an echo plate 124. Stepping on a damper pedal 125 releases all the dampers 122 at the same time. The vibration of that string 121 which is directly vibrated by a hammer (not shown) is transmitted to other strings 121, thus providing rich sounds. In other words, operating damper pedal 125 produces two prominent effects: sustaining of a long envelope from a key-on to a key-off and rich sounding by opening all the strings.

However, the conventional electronic musical instrument can only provide the effect of maintaining a long envelope by operation of, for example, a damper pedal, but cannot provide a sound effect such as rich sounding realized by full open strings in an actual acoustic piano, etc.

For instance, the techniques disclosed in the aforementioned Japanese Patent Disclosure Nos. 54-23518, 58-97092 and 61-172192 are concerned with controlling the volume, timbre or the like of a musical tone by operating various pedals, and nothing is proposed there which is concerned with a technique of adding various effects to a musical tone at the same time.

SUMMARY OF THE INVENTION

Accordingly, it is an object of this invention to provide an electronic musical instrument which can detect the operated amount of a pedal and can add various effects to a musical tone in accordance with a signal representing the operated amount.

To achieve this object, there is provided an electronic musical instrument which causes tone generator means to generate a musical tone corresponding to a musical performance while controlling an envelope by operation of a pedal and which comprises:

operated-amount signal generator means for detecting an operated amount of the pedal and generating an operated-amount signal; and effect adding means for controlling parameters for effect addition so as to add an effect to a musical tone generated from the musical tone generator means in accordance with the operated-amount signal from the operated-amount signal generator means.

In an electronic musical instrument with a pedal according to this invention, the operated amount of the pedal is detected and adding an effect to a musical tone is controlled in accordance with a signal representing this operated amount, whereby various effects can be added to a musical tone by the operation of the pedal, thus making an emotional expression by a player richer.

BRIEF DESCRIPTION OF THE DRAWINGS

FIGS. 2A and 2B illustrate conventional envelopes;

FIG. 3 is a diagram illustrating the status of an envelope with respect to the operation of a key and a pedal;

FIG. 6A is a diagram illustrating pedal values set in step according to the same embodiment;

FIG. 6B is a diagram illustrating envelope values and the amounts of reverberation with respect to the pedal values set in step according to the same embodiment;

FIG. 6C is a diagram illustrating envelopes according to this embodiment;

DETAILED DESCRIPTION OF THE PREFERRED EMBODIMENTS

Preferred embodiments of this invention will be described in detail below with reference to FIGS. 5 through 15C.

Figure 1:
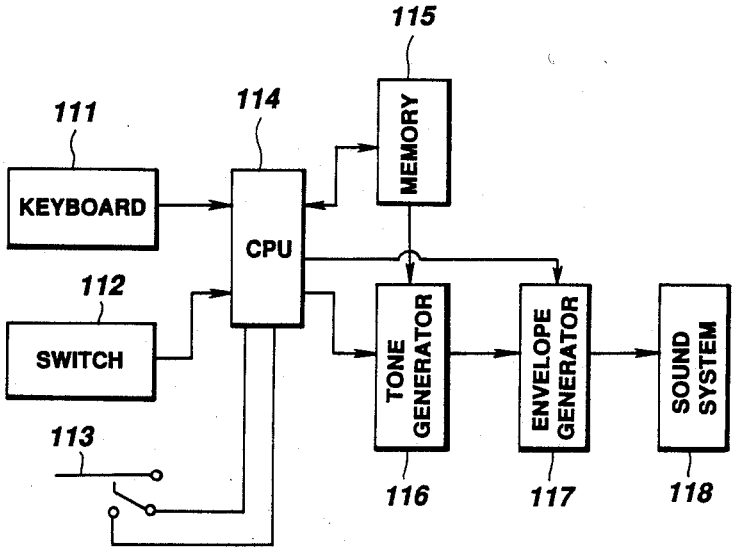
FIG.1 (PRIOR ART)
FIG. 1 is a diagram illustrating the arrangement of a conventional electronic piano.
Figure 4B:
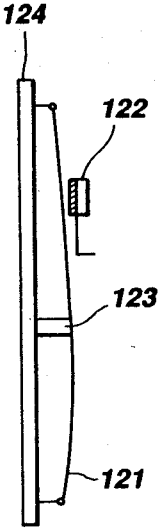
FIG. 4 B (PRIOR ART)
FIG. 4B is a side view of FIG. 4A.
Figure 4A:
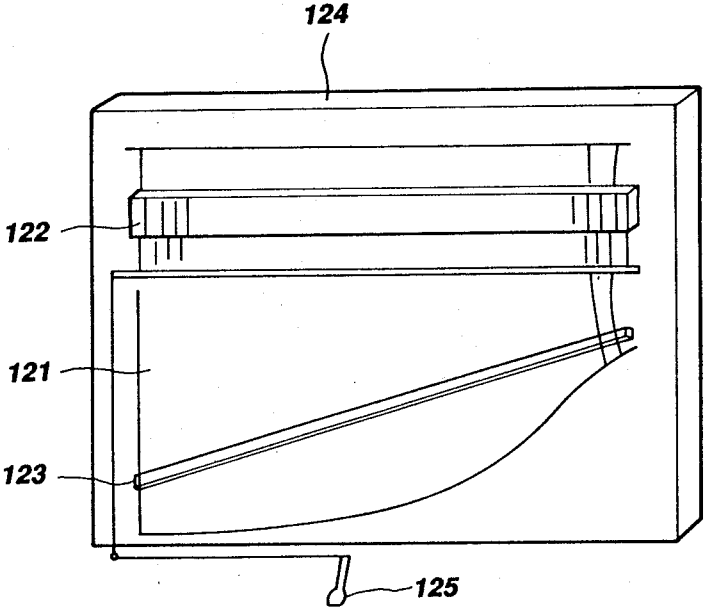
FIG. 4 A (PRIOR ART)
FIG. 4A is a conceptual diagram of a damper section of a conventional acoustic piano.
Figure 5:
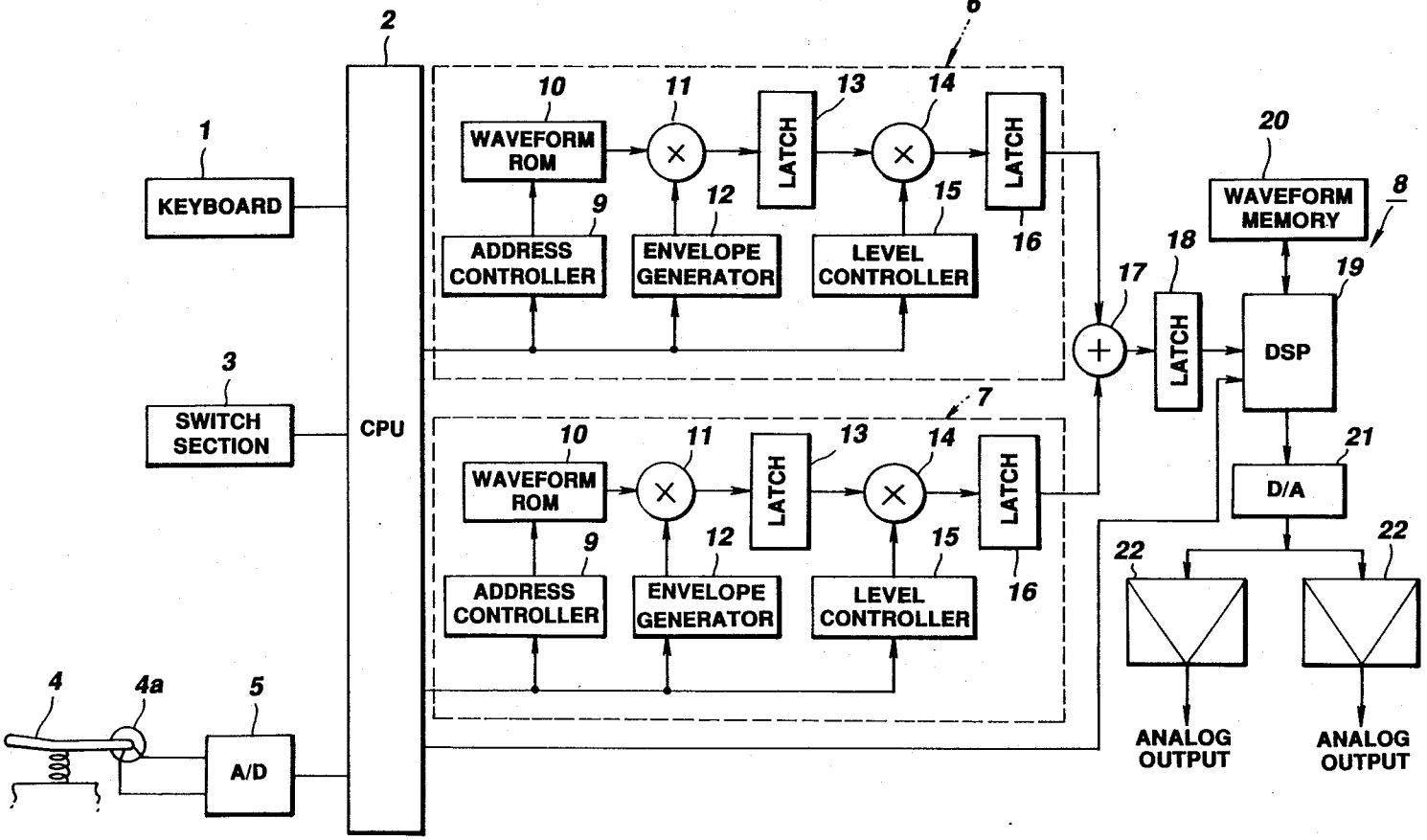
FIG. 5 is a block diagram illustrating the general arrangement of an electronic musical instrument according to one embodiment of this invention.

FIG. 5 is a block diagram illustrating the general arrangement of an electronic musical instrument according to one embodiment of this invention. In the figure, a keyboard 1 is provided with a detector (not shown), e.g., a touch sensor, for detecting a key-touch status, such as the speed of a key depression and depression pressure for each key. Key data outputted from keyboard 1 is supplied through an interface circuit (not shown) to a CPU 2. A switch section 3 has various switches for adding various effects (which will be described later) when operated. Output data of switch section 3 is supplied to CPU 2 through an interface circuit (not shown).

This electronic musical instrument is provided with, for example, a damper pedal 4 as the aforementioned pedal. This damper pedal 4 is provided with a detector 4a for detecting the amount of the pedal operation (operated amount) in terms of a voltage value. A detection signal from detector 4a is converted into a digital signal by an A/D (analog-to-digital) converter 5 and is then supplied to CPU 2.

As shown in FIGS. 6A to 6C, CPU 2 stores pedal values (0–4) varying in step with respect to pedaled amounts of damper pedal 4, envelope values (0–4) corresponding to the pedal values and amounts of reverberation (5–50) as an effect sound (to be described later) in storage means, such as a ROM (read only memory) or a RAM (random access memory). Each envelope value (0–4) represents the level where the release portion reaches, and each reverberation amount (5–50) represents how much reverberation is effective. CPU 2 performs a computation based on data from keyboard 1, switch section 3 and A/D converter 5 and sends a control signal and control data to two-channel PCM (pulse code modulation) sound sources 6 and 7 and an effect adding section 8. A ponderous and high-quality musical tone can be attained by synthesizing output sounds of the PCM sound sources 6 and 7 for generation of a single musical tone.

Based on a designated scale supplied from CPU 2, an address controller 9 of PCM sound source 6 sends a read address to a waveform ROM 10 in which predetermined tone waveform data is stored. Waveform data read out from waveform ROM 10 is supplied to a multiplier 11. This multiplier 11 multiplies the waveform data from waveform ROM 10 by an envelope from an envelope generator 12, which is controlled by CPU 2, and sends the multiplied result to a latch circuit 13. The output of this latch circuit 13 is multiplied in a multiplier 14 by a volume level from a level controller 15, and is supplied to a latch circuit 16. This level controller 15 receives a signal representing a volume level, which is supplied from CPU 2 according to key data, and sends the volume level signal to multiplier 14. The synthesizing ratio of two-channel musical tones is independently controlled by this level signal. The other PCM sound source 7 has an address controller 9, waveform ROM 10, multipliers 11 and 14, envelope generator 12, latch circuits 13 and 16 and level controller 15 similar to those of PCM sound source 6. The outputs of latch circuits 16 of PCM sound sources 6 and 7 are synthesized by an adder 17, and the synthesized output is supplied through a latch circuit 18 to a DSP (digital signal processor) of effect adding section 8. DSP 19 stores input signal data from latch circuit 18 into a waveform memory 20, performs a predetermined arithmetic operation for effect addition on the stored data, then reads the data from memory 20 and sends it to a D/A (digital-to-analog) converter 21. This D/A converter 21 converts the received digital signal to an analog signal which is outputted as an effect-added stereo musical tone through output sections 22 each comprising an output amplifier. CPU 2 generates a parameter change command in accordance with an operated or touched key on keyboard 1 or an operation signal from switch section 3 and sends the command to DSP 19.

Figure 7:
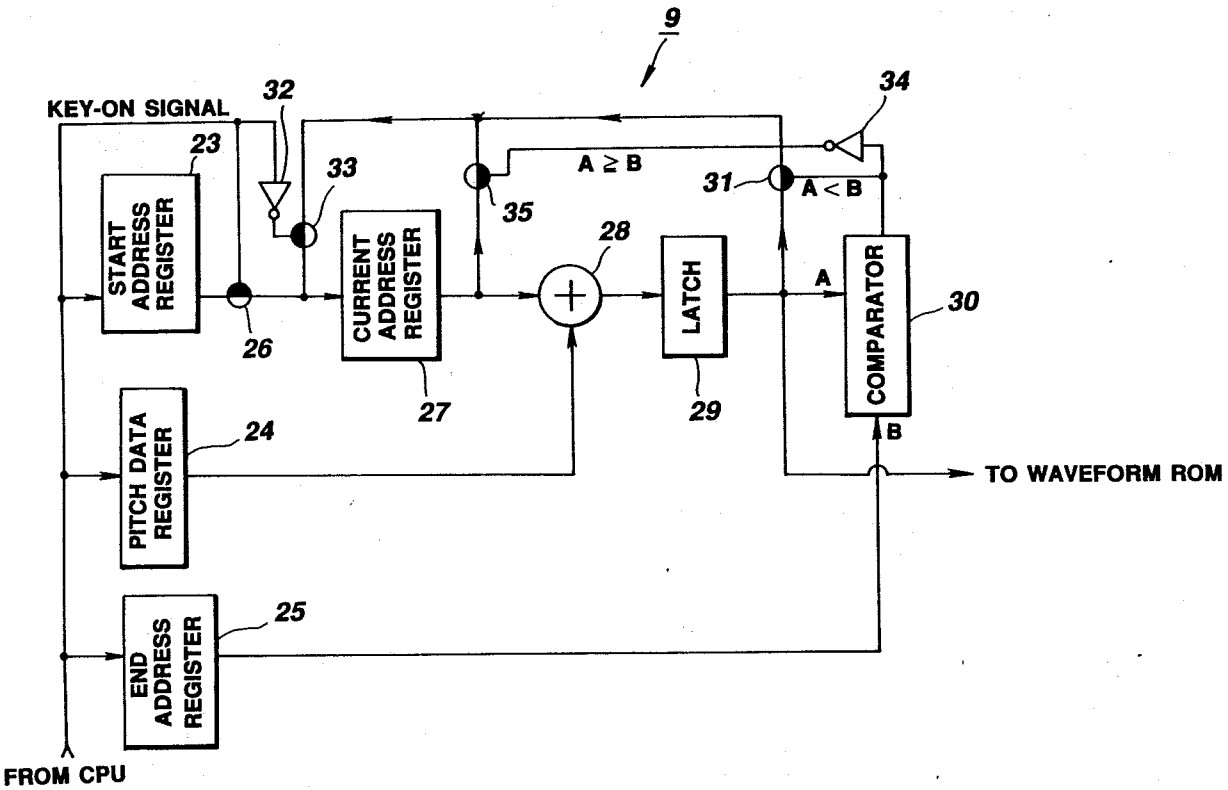
FIG. 7 is a block diagram illustrating an address controller shown in FIG. 5.

FIG. 7 is a block diagram illustrating an example of address controller 9 shown in FIG. 5. In FIG. 7 a start address register 23 stores a start address for data readout, a pitch data register 24 stores read address interval data, and an end address register 25 stores end address data for data readout. Data to be stored in each register 23, 24 or 25 is supplied from CPU 2. The address data stored in start address register 23 is latched in a current address register 27 through a gate 26 whose gating operation is controlled by a key-on signal from CPU 2. The address data stored in current address register 27 is added, by an adder 28, to the pitch data stored in pitch data register 24, and the added data is then supplied to a latch circuit 29. The aforementioned pitch data is determined on the basis of the frequency of an output sound, and the address incrementing speed is determined by this pitch data. The address data latched in latch circuit 29 is compared with the end address data stored in end address register 25 by a comparator 30, and is also supplied to waveform ROM 10 as a read address. The address data latched in latch circuit 29 is also fed back to current address register 27 through gates 31 and 33; the former gate 31 is opened only when the comparison result from comparator 30 indicates that the address data does not exceed the end address and the latter one is opened only by a signal which is the key-on signal inverted by an inverter 32. When the current address coincides with or exceeds the end address, the address data in current address register 27 is fed back to this register 27 through a gate 35 and the gate 33; the gate 35 is controlled by a signal which is the output signal from comparator 30 inverted by an inverter 34. Consequently, the address increment is stopped.

Figure 8:
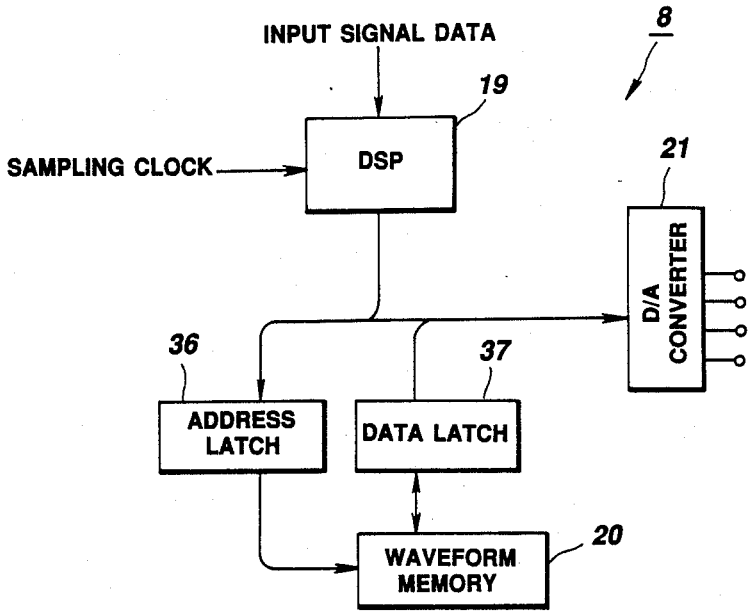
FIG. 8 is a block diagram illustrating a DSP (digital signal processor) shown in FIG. 5.

FIG. 8 is a detailed block diagram of effect adding section 8 for adding an effect to a musical tone. In the figure, DSP 19 receives an input signal supplied from latch circuit 18 by a given sampling clock, performs an effect adding process (which will be described later) and sends its output to D/A converter 21. Waveform memory 20, which stores input signal data under the control of DSP 19, receives write and read addresses from an address latch circuit 36. Write and read data are latched in a data latch circuit 37. DSP 19 further has a parameter memory (not shown) for storing various control parameters for adding effects to a musical tone (which will be described later).

A description will now be given of the operation of the thus constituted electronic musical instrument.

First, when a key on keyboard 1 is operated, the key-touch status such as key depression speed and depression pressure is detected by the detector (not shown) and key data representing the position of the operated key and the key-touch status is supplied to CPU 2. When a switch or switches in switch section 3 are operated for an effect adding operation, the switch data is supplied to CPU 2. When damper pedal 4 is operated, the operated amount is detected by detector 4a and is then converted into a digital value in A/D converter 5 before it is supplied to CPU 2. Based on the key data, switch data and operational data of the damper pedal, CPU 2 sends control data corresponding to the received data to two-channel PCM sound sources 6 and 7 and also sends parameter and flag change data (parameter change message) for effect addition to DSP 19 of effect adding section 8. This change data specifies a reverberation parameter (e.g., reverberation amount) corresponding to a pedal operation amount as shown in FIG. 2B.

Address controller 9 of each PCM sound source 6 or 7 is supplied with the start address data, pitch data and end address data from CPU 2 in accordance with the key data, and the first three data are respectively stored in start address register 23, pitch data register 24 and end address register 25. Then, upon reception of a key-on pulse signal, gate 26 is opened so that the start address data is stored in current address register 27. After the key-on signal is outputted, gate 33 is opened by inverter 32. The address data in current address register 27 is added to the pitch data from pitch data register 24 by adder 28 and the resultant data is supplied through latch circuit 29 to waveform ROM 10 as well as comparator 30. Gate 31 is opened and gate 35 is closed by the output signal of comparator 30 while the address data in latch circuit 29 does not exceed the end address. Consequently, the address data in latch circuit 29 is fed back through gates 31 and 33 to current address register 27 whose output is again added to the pitch data in adder 28, and the resultant data is supplied to comparator 30 and waveform ROM 10. In other words, the address data in latch circuit 29 is incremented until this data reaches the end address as it, starting from the start address, is sequentially added with the pitch data. When comparator 30 discriminates that the address data in latch circuit 29 either equals or exceeds the end address, gate 31 is closed and gate 35 is opened by the output signal of comparator 30. This stops the incrementing of the address data in latch circuit 29, so that the address data in current address register 27 is fed back again to register 27 through gates 35 and 33, thus maintaining a constant value. Therefore, the frequency of the waveform read out from waveform ROM 10 is low when the pitch data is small and is high when it is large. Consequently, a sound of a scale corresponding to the operated key on keyboard 1 is attained.

The output of latch circuit 18 in FIG. 5 is latched in DSP 19 of effect adding section 8 as input signal data of a musical tone for each sampling period, and the necessary effect adding process is executed within one sampling period through a digital signal processing in a time-shared manner. At this time, selection of an effect adding process and parameter alteration are executed in accordance with the key data and switch data from CPU 2. The output data, which has been subjected to an effect adding process in DSP 19, is converted into a digital signal by D/A converter 21 and is outputted through output sections 22 as an effect-added stereo sound.

A description will now be given of the operation of CPU 2 when damper pedal 4 is operated and the operation of DSP 19 for the effect adding process.

Figure 9A:
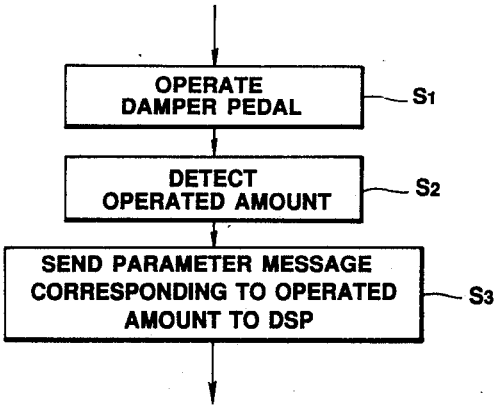
FIG. 9A is a flowchart illustrating the operational sequence resulting from the operation of a damper pedal.

The flowchart shown in FIG. 9A illustrates the operation of CPU 2 when damper pedal 4 is operated. To begin with, when the operation of damper pedal 4 is detected in step S1, the operated amount is detected by detector 4a and is supplied to CPU 2 after it is converted into a digital signal by A/D converter 5 in step S2. In return, CPU 2 reads an envelope and reverberation amount corresponding to the pedal-operated amount and sends a parameter change message to DSP 19 to change, for example, the reverberation amount in step S3.

Figure 9B:
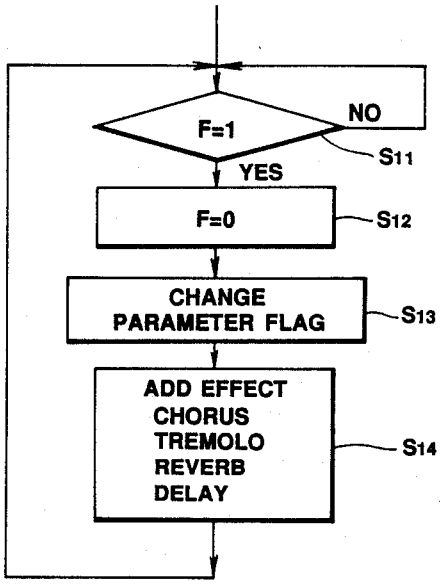
FIG. 9B is a flowchart illustrating the operation of an effect adding process.

The flowchart shown in FIG. 9B illustrates the operation of DSP 19 for the effect adding process. When externally supplied with a sampling clock, DSP 19 has its flag F set to "1". In step S11, therefore, it is discriminated whether or not the flag F is "1". If F=1, then the flag F is set to "0" in step S 12. That is, each process is executed in synchronization with the external sampling clock. Then, the flow advances to the subsequent step S13 where the parameters and flag given from CPU 2 for an effect adding process are altered. This alteration process is carried out by, for example, changing one parameter or flag for each sampling or gradually changing the parameter to a target parameter given while interpolating the parameter between a predetermined sampling block. In the next step S14, an effect selected by a switch in switch section 3 is added in accordance with the data supplied from CPU 2. The effect adding process involves adding of, for example, a chorus effect (CHORUS), tremolo effect (TREMOLO), reverberation effect (REVERB) or delay effect (DELAY). According to this embodiment, the reverberation effect adding process is executed and the alteration of the reverberation amount (indicated as RDPTH in FIG. 13) is controlled by the operation of pedal 4. The flow returns to step S11 and a similar process is thereafter repeated for every sampling block.

Figure 10:
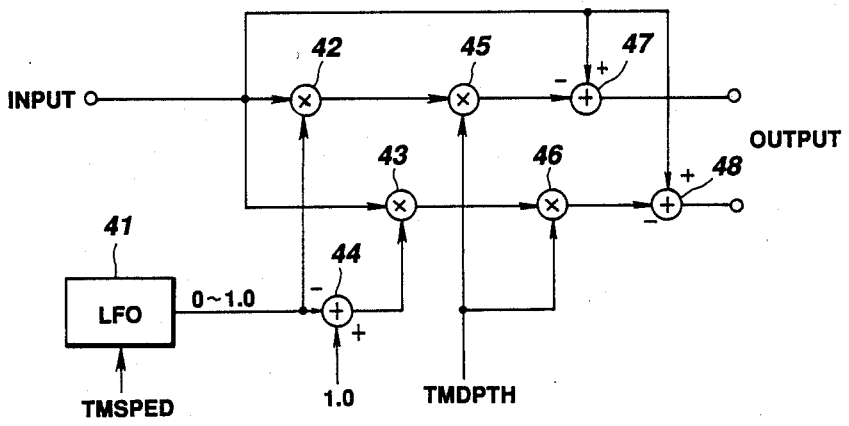
FIG. 10 is a functional block diagram exemplifying a tremolo effect addition according to this embodiment.

FIG. 10 is a functional block diagram illustrating an example of the tremolo effect adding process. That is, DSP 19 realizes the illustrated function. The other effect adding processes are similarly realized by DSP 19. This functional arrangement shown in FIG. 10 provides a stereo output with a tremolo effect by executing an arithmetic operation using low-frequency waveform data (1.0–0) from a LFO (low frequency oscillator) 41. LFO 41 reads out waveform data from a memory that stores, for example, given waveform data for each sampling period to thereby generate a low-frequency waveform (e.g., a sine wave) whose frequency varies by a parameter TMSPED that determines the tremolo speed. The frequency of this waveform data ranges between 0.15 to 940 Hz, for example. The input signal data is supplied to two multipliers 42 and 43; the former multiplier 42 multiplies the input signal data by the output of LFO 41 while the latter, 43, multiplies the input signal data by the output of an adder 44 which is "1" added to the output of LFO 41 whose sign has been changed. The outputs of multipliers 42 and 43 are respectively supplied to multipliers 45 and 46. In other words, the input signal data is multiplied by the output waveform of LFO 41 on one hand and it is multiplied, on the other hand, by a waveform with a phase difference of 180° which is attained by subtracting the output waveform of LFO 41 from "1". Multipliers 45 and 46 respectively multiply the outputs of multipliers 42 and 43 by a parameter TMDPTH that determines the depth of tremolo. The outputs of multipliers 45 and 46 are respectively supplied to adders 47 and 48, which respectively add the input signal data to the outputs of multipliers 45 and 46 with their signs changed. The added outputs of adders 47 and 48 are two stereo outputs. More specifically, with TMDPTH=0, the original input signal data is outputted as it is, and with TMDPTH=1, input waveform data that has undergone 100% amplitude modulation is outputted.

Figure 11:
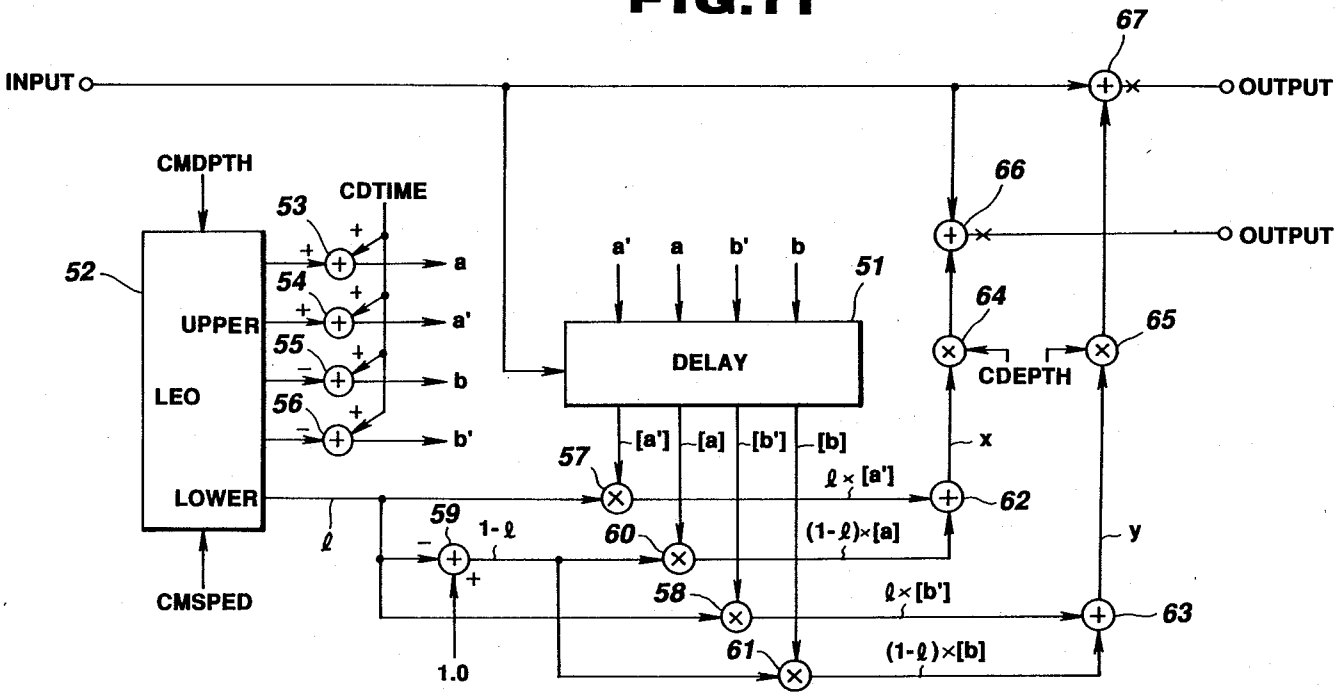
FIG. 11 is a functional block diagram exemplifying a chorus effect addition according to this embodiment.

FIG. 11 is a block diagram illustrating an example of a chorus effect adding process. The functional arrangement shown in FIG. 11 has a delay circuit 51 for delaying waveform data and an LFO 52 similar to the aforementioned type and provides a stereo output with a chorus effect added by means of an arithmetic operation. Delay circuit 51 sequentially stores input signal data which is later read out delayed. This circuit 51 is so designed to read out a waveform from waveform memory 20 shown in FIG. 8 with some delay. Each delay circuit which will be described later is similarly constituted. LFO 52, which generates a low-frequency waveform, has four integer outputs at its upper portion and a single fraction output at its lower portion and changes the depth and speed of modulation by a parameter CMDPTH for determining the modulation depth and a parameter CMSPED for determining the modulation speed. A delay parameter CDTIME is added to, or subtracted from, the four integer outputs of LFO 52 respectively by adders 53 to 56, and the resultant added or subtracted outputs a, a', b and b, are supplied as a read address to delay circuit 51. The outputs a' and b' represent address data previous to, or succeeding from, by one, the added outputs a and b, respectively.

It should be obvious from FIG. 11 that a, a', b and b' would take the following values.

$a=h+CDTIME$ $a'=h+1+CDTIME$ $b=-h+CDTIME$ $b'=-h-1+CDTIME,$ where h represents upper data of the output of LFO 52. The fractional output 1 of LFO 52 and waveform data [a'] and [b'] from delay circuit 51 are respectively multiplied by each other by multipliers 57 and 58. The fractional output 1 is also supplied to an adder 59 which changes the sign of the received data and adds "1" to it. The output of this adder 59 is multiplied by the waveform data [a] and [b] from delay circuit 51 by multipliers 60 and 61, respectively. The outputs of multipliers 57 and 60 are added together by an adder 62, and the outputs of multipliers 58 and 61 by an adder 63. The outputs, x and y, of adders 62 and 63 are expressed by the following equations:

$x=(1-1)\ x\ [a]+1\ x\ [a']$ $y=(1-1)\ x\ [b]+1\ x\ [b'].$

That is, x and y are attained by performing the interpolation of the read waveform data [a] and [a'] and the interpolation of the read waveform data [b] and [b'] with the fractional output 1. Further, the outputs of adders 62 and 63 are multiplied by a parameter CDEPTH for determining the depth of a chorus by multipliers 64 and 65, respectively. The outputs of multipliers 64 and 65 are added with the input signal data respectively by adders 66 and 67 to be two stereo outputs. A right shift is carried out on the output side of each of adders 66 and 67 to avoid an overflow. (This shift is indicated by "x" in FIG. 11.)

In short, the integer outputs of LFO 52 specify a read address for low-frequency waveform data around the delay parameter CDTIME and such waveform data is read out from delay circuit 51. The read, adjoining waveform data is subjected to interpolation with the fractional output of LFO 52, and the resultant data is multiplied by the parameter CDEPTH for determining the chorus depth and is further added with the input signal data for frequency modulation, thereby providing stereo outputs with the chorus effect added thereto.

Figure 12:
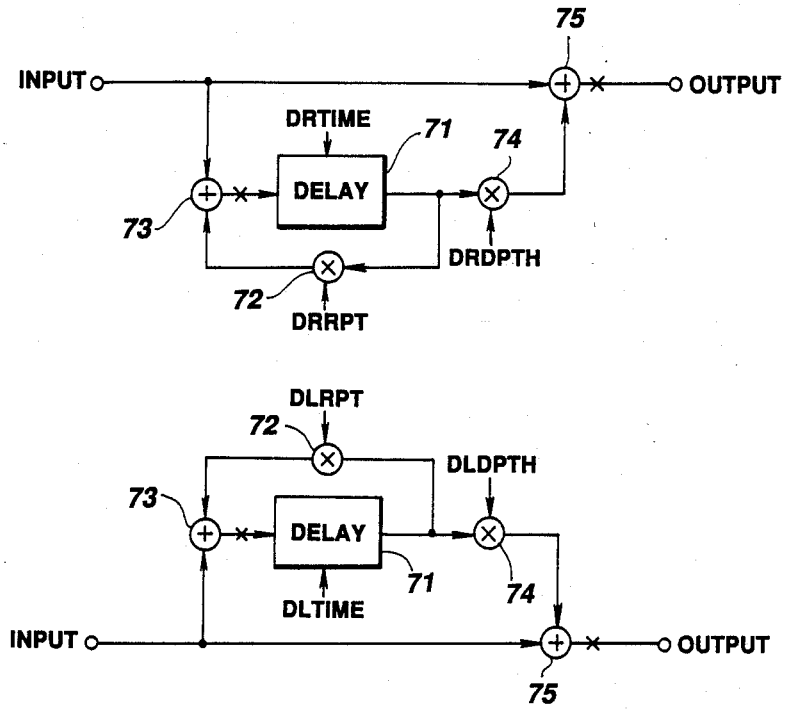
FIG. 12 is a functional block diagram exemplifying a delay effect addition according to this embodiment.

FIG. 12 is a functional block diagram illustrating an example of a delay effect adding process. In this example, in order to provide two stereo outputs, there are two independent sets of circuits of the same structure each having a delay circuit 71. These delay circuits 71 delay waveform data by their respective delay parameters DRTIME and DLTIME and their outputs are multiplied by repeat parameters DRRPT and DLRPT by multipliers 72 located in the respective feedback loops. The outputs of multipliers 72 are added with the input signal data by the respective adders 73 and are then supplied to delay circuits 71. The outputs of delay circuit 71 are multiplied by parameters DRDPTH and DLDPTH for determining the depth of delay by the respective multipliers 74 and are then added with the input signal data by adders 75 to be two stereo outputs. The right shift (indicated by "x") is carried out on the output side of each of adders 73 and 75 as per the previous example.

In other words, the input signal data is delayed by delay circuits 71 each having a feedback loop and is added with the input signal data, thereby providing stereo outputs with the delay effect added thereto.

Figure 13:
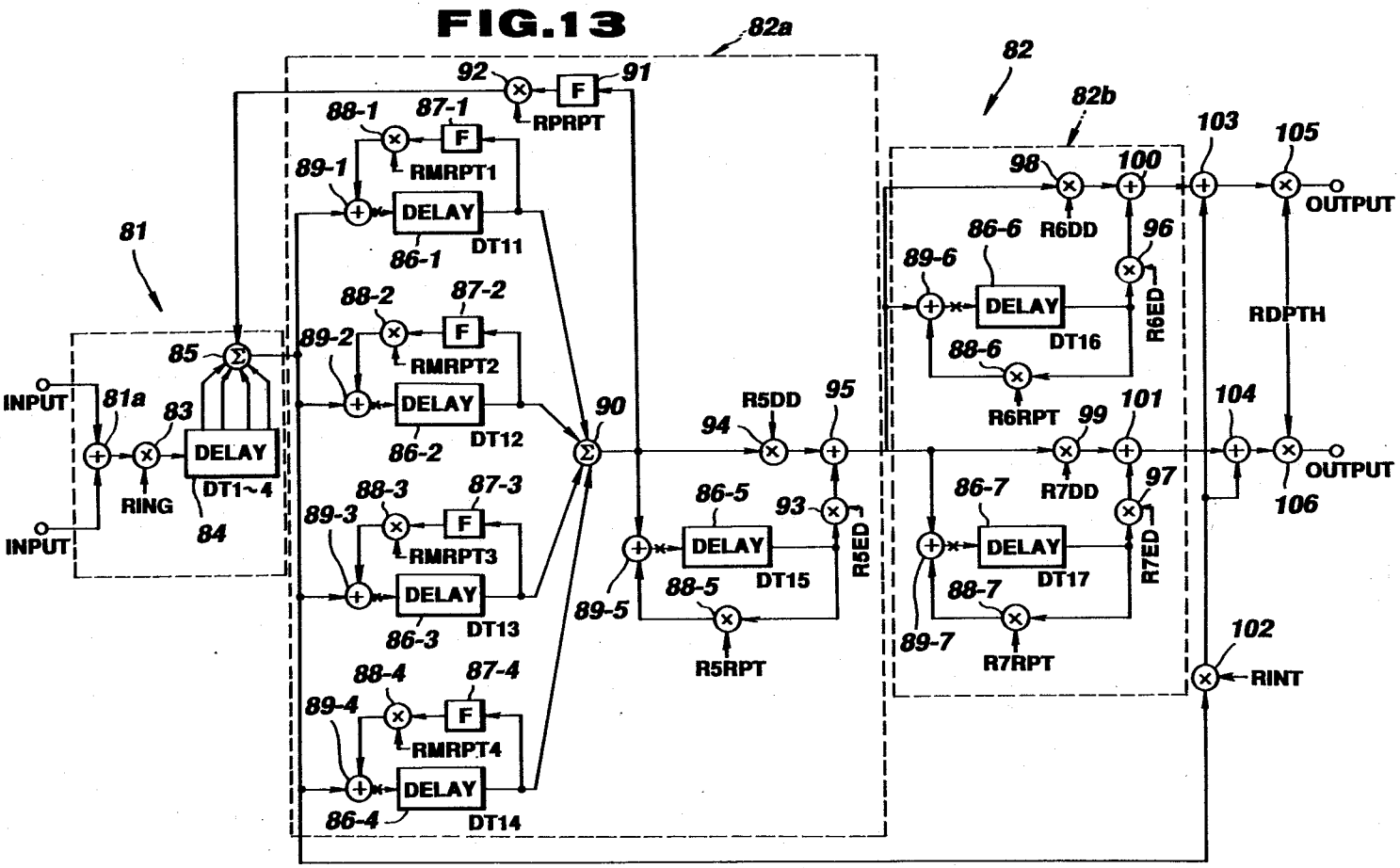
FIG. 13 is a functional block diagram exemplifying a reverberation effect addition according to this embodiment.

FIG. 13 is a functional block diagram illustrating an example of a reverberation effect adding process. This circuit comprises an initial echo adding means 81 and a reverberation adding section 82, which includes a reverberation adding section 82*a* in the input stage and a stereo section 82*b* in the output stage.

The initial echo adding section 81 has an adder 81*a* for adding two input signals, a multiplier 83 for multiplying the output of adder 81*a* by a volume parameter RING, a delay circuit 84 for providing delay outputs DT1-DT4 from a plurality of intermediate taps as initial echoes with respect to the output of multiplier 83, and an adder 85 for adding the delay outputs.

Reverberation adding section 82*a* has a plurality of delay circuits 86-1 to 86-5 each having a feedback loop, which are independently-set with the respective delay times DT11-DT15. The feedback loops of delay circuits 86-1 to 86-4 are respectively provided with low-pass filters 87-1 to 87-4 and multipliers 88-1 to 88-4 for multiplying the outputs of these filters by repeat parameters RMRPT1-RMRPT4. The feedback loop signal data are added to the output of adder 85 respectively by adders 89-1 to 89-4 provided on the input sides of delay circuits 86-1 to 86-4. The outputs of adders 89-1 to 89-4 are subjected to a right-shifting process (see the mark "x") and are then supplied to their associated delay circuits 86-1 to 86-4. The outputs of these delay circuits 86-1 to 86-4 are added together by an adder 90. The output of adder 90 is supplied through a low-pass filter 91 to a multiplier 92 where it is multiplied by a repeat parameter RPRPT and is fed back to adder 85. The feedback loop of delay circuit 86-5 is provided with a multiplier 88-5 for multiplying the output of the circuit 86-5 by a repeat parameter R5RPT, and feedback loop signal data is added with the output signal of adder 90 by an adder 89-5 provided on the input side of delay circuit 86-5. The output of this adder 89-5 is subjected to the right-shifting process (indicated by the mark "x") and is then supplied to delay circuit 86-5. A value attained by multiplying the output of delay circuit 86-5 by a volume parameter R5ED by a multiplier 93 is added, by an adder 95, to a value attained by multiplying the output of adder 90 by a volume parameter R5DD by a multiplier 94.

Stereo circuit 82*b*, which makes a stereo output of the output of reverberation adding section 82*a*, has two delay circuits 86-6 and 86-7, each having a feedback loop are independently set with delay times DT16 and DT17. On the feedback loops are provided multipliers 88-6 and 88-7 for multiplying the outputs of the respective delay circuits 86-6 and 86-7 by repeat parameters R6RPT and R7RPT, and feedback loop signal data are added with the output of adder 95 by adders 89-6 and 89-7 provided on the input sides of the respective delay circuits 86-6 and 89-7. The outputs of these adders 89-6 and 89-7 are subjected to the right-shifting process (indicated by "x") and are then supplied to the respective delay circuits 86-6 and 86-7. Values attained by multiplying the outputs of delay circuits 86-6 and 86-7 by volume parameters R6ED and R7ED by multipliers 98 and 99 are respectively added, by adders 100 and 101, to values attained by multiplying the output of adder 9 by volume parameters R6DD and R7DD by multipliers 98 and 99. The outputs of these adders 100 and 101 are added, by adders 103 and 104, with a value attained by multiplying the output of adder 85 of echo adding section 81 by a volume parameter PINT by a multiplier 102. The outputs of adders 103 and 104 are multiplied by a parameter RDPTH for determining a reverberation depth by multipliers 105 and 106, which produce stereo outputs with a reverberation effect added thereto.

In short, the input signal data is delayed by a plurality of delay times DT1-DT4 by a delay circuit 84 and the resultant delayed data are added together by adder 85. Here, the parameter RING for multiplier 83 is adjusted to prevent an overflow and noise. The initial echo of adder 85 is supplied to adders 89-1 to 89-4 where it is added with the respective feedback signals attained by multiplying the outputs of delay circuits 86-1 to 86-4 by the repeat parameters RMRPT1-RMRPT4. The resultant signals are respectively supplied to delay circuits 86-1 to 86-4 to be delayed by their respective delay times DT11-DT14. The delayed signals are added together by adder 90 and the resultant signal is further delayed by delay circuit 86-5. The output of adder 90 is multiplied by the repeat parameter RPRPT by multiplier 92 located in the feedback loop and is then supplied back to adder 85. By setting the phase of the repeat parameters parameter RPRTP opposite to the phases of the repeat RMRPT1-RMRPT4, the feedback amounts of the individual delay circuits 86-1 to 86-4 can be reduced while increasing other feedback amounts to thereby prevent resonance. In addition, low-pass filters 87-1 to 87-4 and 91 attenuate the high frequency components to provide a natural reverberation effect. The output of adder 95 is delayed by delay circuits 86-6 and 86-7 in stereo circuit 82*b*, which have feedback loops and multipliers 88-6 and 88-7 for multiplying the outputs of the circuit 86-6 and 86-7 by the repeat parameters R6RPT and R7RPT, and the resultant delayed signals are subjected to volume control and are then added to the signals from multipliers 98 and 99 by adders 100 and 101, respectively. The outputs of adders 100 and 101 are complex reverberation sounds which have different reverberation times and have a large variation in frequency component. The reverberation sounds are added with the initial echo which has been subjected to volume (RING) control by multiplier 102 and are further multiplied by the reverberation depth (RDPTH), thereby providing stereo outputs. The reverberation depth (RDPTH) is determined by the operated amount of the damper pedal. A tone signal with this reverberation effect added thereto is synthesized with the original tone (though not shown in FIG. 13) before it is outputted. Therefore, the ratio of the reverberation sound to the original sound is controlled by the parameter RDPTH and this ratio is varied by the operation of damper pedal 4, thus improving the effect of a musical performance.

Figure 14:
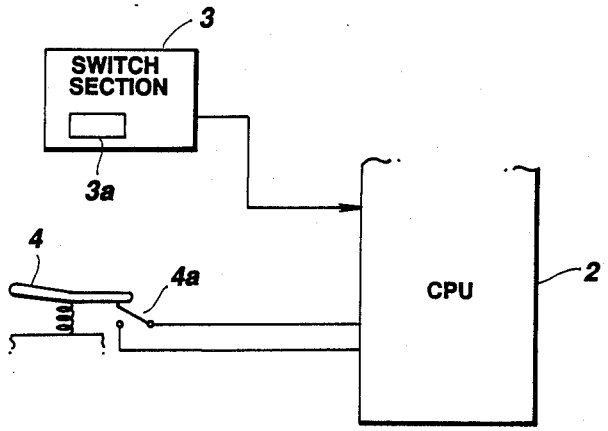
FIG. 14 is a diagram illustrating the arrangement of a damper pedal section according to another embodiment.
Figures 15A, 15B, 15C:
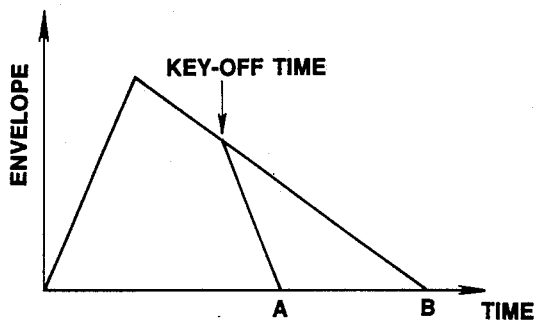
FIGS. 15A and 15C are diagrams illustrating parameters of a musical tone with respect to pedal values set in two stages according to the second embodiment.
FIG. 15B is a diagram illustrating envelope values according to this second embodiment.

FIG. 14 is a diagram illustrating the arrangement of the damper pedal section according to another embodiment of this invention. According to this embodiment, a switch 4*b* is provided as a detector for detecting the ON/OFF state of damper pedal 4. CPU 2 is set with two-stage data, such as envelopes A and B and reverberation amounts 5 and 20 in association with the ON and OFF states of the pedal 4, as shown in FIGS. 15A to 15C.

With the above arrangement, two types of envelopes and effect sounds are added to a musical tone in accordance with the operation of the damper pedal, as per the first embodiment.

Although the reverberation parameter is changed in accordance with the operated amount of damper pedal 4 in the first embodiment, those parameters for various effects (such as chorus, tremolo, delay and reverberation) selected by a player can also be controlled in accordance with the operated amount of the damper pedal 4. More specifically, as shown in FIG. 14, a designation switch 3*a* is provided in switch section 3, and, operating this switch 3*a*, the player selects in advance the effect to be controlled according to the operated amount of damper pedal 4. CPU 2 is set with two-stage data about each of an envelope, reverberation amount, tremolo effect, chorus effect and delay effect. And, in accordance with the operation of damper pedal 4, control data is supplied to PCM sound sources 6 and 7 and DSP 19 from CPU 2. Accordingly, adding the chorus, tremolo, reverberation or delay effect to a musical tone is selected and the envelope is controlled. For instance, with regard to the tremolo effect, the parameters TMSPED and TMDPTH for determining the tremolo speed and tremolo depth are properly selected in accordance with the operated amount of damper pedal 4.

With regard to the chorus effect, the parameters CMDPTH, CMSPED and CDEPTH for determining the modulation depth, modulation speed and chorus depth are properly selected in accordance with the operated amount of the damper pedal.

With regard to the delay effect, the parameters DRTIME, DLTIME, DRRPT, DLRPT, DRDPTH, and DLDPTH for determining the delay time, repeat depth and delay depth are properly selected in accordance with the operated amount of the damper pedal.

With regard to the reverberation effect, the parameters DT1-17, RMRPT1-4, R4RPT-R7RPT, RDPTH and RINT for determining the delay time, repeat depth, reverberation depth and initial echo amount are properly selected in accordance with the operated amount of damper pedal.

Therefore, it is possible to add various effects to a musical tone in accordance with data of the operated amount of damper pedal 4, etc. and to effectively express the feeling of the player. For instance, with a large operated amount of the pedal, it is possible to provide a musical effect attained in a large hall (e.g., setting a large delay time for the delay or reverberation effect).

Although, in the above embodiments, the chorus, tremolo, delay and reverberation effects can be attained, other effects may be attained and combinations of the effects are not limited to those discussed with reference to these embodiments.

Although damper pedal 4 is used in the above embodiments, a desired effect may be added to a musical tone in accordance with the operation of another pedal, such as a sostenuto pedal or soft pedal. In addition, the parameters for adding the desired effect to a musical tone according to the operated amount of the pedal can be properly determined by the type of the pedal in use and the type of the effect to be added.

What is claimed is:

1. A musical tone control system for controlling a musical tone generated from a tone generator means, comprising:

a pedal means which is operable for designating addition of an envelope and an effect to said musical tone;

operated-amount signal generator means, coupled to said pedal means, for detecting an operated amount of said pedal means and for generating an operated-amount signal;

system control means, coupled to said operated-amount signal generator means, for outputting an envelope-control signal and for also outputting an effect control signal for changing a parameter in accordance with said operated-amount signal;

envelope control means, coupled to said tone generator means and to said system control means, for controlling an envelope of said musical tone which is generated from said tone generator means, in accordance with said envelope-control signal output from said system control means; and effect adding means, coupled to said tone generator means and to said system control means, for adding said effect to said musical tone in accordance with said parameter which is changed by said effect control signal which is output from said system control means, said parameter thereby controlling the addition of said effect to said musical tone as a function of the operated amount of said pedal means.

2. The musical tone control system of claim 1, wherein said pedal means comprises at least one of a damper pedal, a sostenuto pedal and a soft pedal.

3. The musical tone control system of claim 1, wherein said operated-amount signal generator means includes means for detecting two ON/OFF statuses of said pedal means as the operated amount of said pedal means.

4. The musical tone control system of claim 1, wherein said operated-amount signal generator means includes means for detecting at least two statuses of said pedal means as the operated amount of said pedal means.

5. The musical tone control system of claim 1, wherein said effect adding means includes at least one of tremolo effect adding means, chorus effect adding means, delay effect adding means and reverberation effect adding means.

6. The musical tone control system of claim 5, wherein said effect adding means includes a tremolo effect adding means, and said tremolo effect adding means includes means for selecting at least one of parameters for determining a tremolo speed and a tremolo depth in accordance with said effect control signal output from said system control means.

7. The musical tone control system of claim 5, wherein said effect adding means includes chorus effect adding means, and said chorus effect adding means includes means for selecting at least one of parameters for determining a modulation depth, a modulation speed and a chorus depth in accordance with said effect control signal output from said system control means.

8. The musical tone control system of claim 5, wherein said effect adding means includes delay effect adding means, and said delay effect adding means includes means for selecting at least one of parameters for determining a delay time, a repeat depth and a delay depth in accordance with said effect control signal output from said system control means.

9. The musical tone control system of claim 5, wherein said effect adding means includes reverberation effect adding means, and said reverberation effect adding means includes means for selecting at least one of parameters for determining a delay time, a repeat depth, a reverberation depth and an initial echo amount in accordance with said effect control signal output from said system control means.

10. The musical tone control system of claim 1, wherein said effect adding means includes plural types of effect adding means, and means for adding plural types of effects in accordance with said effect control signal output from said system control means.

* * * * *